US009303367B2

(12) United States Patent
Bakken et al.

(10) Patent No.: US 9,303,367 B2
(45) Date of Patent: Apr. 5, 2016

(54) APPARATUS FOR APPLYING VISCOUS MASS TO A SURFACE, METHOD FOR CLEANING VALVES THEREOF AND TRAFFIC PRINTER BASED ON SUCH APPARATUS

(75) Inventors: Erik Bakken, Trysil (NO); Jari Pasanen, Stöllet (SE)

(73) Assignee: Trysil Maskin AS, Nybergsund (NO)

( * ) Notice: Subject to any disclaimer, the term of this patent is extended or adjusted under 35 U.S.C. 154(b) by 27 days.

(21) Appl. No.: 14/003,968

(22) PCT Filed: Mar. 9, 2012

(86) PCT No.: PCT/NO2012/050038

§ 371 (c)(1),
(2), (4) Date: Sep. 9, 2013

(87) PCT Pub. No.: WO2012/144908

PCT Pub. Date: Oct. 26, 2012

(65) Prior Publication Data

US 2013/0340675 A1 Dec. 26, 2013

(30) Foreign Application Priority Data

Mar. 11, 2011 (NO) ..... 20110379

(51) Int. Cl.

| | |
|---|---|
| ***B05B 7/06*** | (2006.01) |
| ***B05B 7/16*** | (2006.01) |
| ***B05B 9/06*** | (2006.01) |
| ***B05B 1/24*** | (2006.01) |

(Continued)

(52) U.S. Cl.

CPC ..... *E01C 11/00* (2013.01); *E01C 23/243* (2013.01)

(58) Field of Classification Search

USPC ..... 118/313–315, 323, 321, 58, 302; 251/144; 404/94; 239/130, 135, 172

See application file for complete search history.

(56) References Cited

U.S. PATENT DOCUMENTS 3,780,981 A * 12/1973 Horak et al. ..... 251/144
3,964,835 A * 6/1976 Eigenmann ..... 404/94

(Continued)

FOREIGN PATENT DOCUMENTS

DE 4302934 A1 10/1994
EP 1985762 A1 10/2008

(Continued)

OTHER PUBLICATIONS

International Search Report and Written Opinion dated Aug. 20, 2012.

*Primary Examiner* — Yewebdar Tadesse
(74) *Attorney, Agent, or Firm* — Alix, Yale & Ristas, LLP

(57) ABSTRACT

Applicator (11) for application of a viscous mass (31) to a surface (33) comprising a heated chamber (32) in communication with openings (12) controlled by valves (14) allowing dropwise discharge of the viscous mass to the surface. The valves (14) are non-packed and comprise an outer sleeve (15) having at least one through opening (16) in its sleeve wall and valve plug (17) adapted to the internal surface of the sleeve (15). The valve plug (17) is reciprocated by a valve lifter (18) from a closed position completely sealing the at least one through opening (16) in the sleeve wall, to an elevated open position exposing at least the lowermost part of the at least one through opening (16) allowing viscous mass (31) to pass from the outside of the sleeve (15) to the inside thereof.

15 Claims, 3 Drawing Sheets

(51) Int. Cl.

| | |
|---|---|
| ***B05B 15/02*** | (2006.01) |
| ***E01C 11/00*** | (2006.01) |
| ***E01C 23/24*** | (2006.01) |

(56) References Cited

U.S. PATENT DOCUMENTS

| | | | |
|---|---|---|---|
| 4,375,275 | A | 3/1983 | Argazzi |
| 6,475,282 | B1 | 11/2002 | Snodgrass et al. |
| 2008/0236485 | A1 | 10/2008 | Sibbers et al. |

FOREIGN PATENT DOCUMENTS

| | | | |
|---|---|---|---|
| JP | 3286006 | A | 12/1991 |
| WO | 0197981 | A1 | 12/2001 |

* cited by examiner

APPARATUS FOR APPLYING VISCOUS MASS TO A SURFACE, METHOD FOR CLEANING VALVES THEREOF AND TRAFFIC PRINTER BASED ON SUCH APPARATUS

BACKGROUND

The disclosure concerns an apparatus in the form of an applicator to deposit a viscous, flowable mass to a surface, such as roadways, parking areas, air port runways and the like. The disclosure also concerns a traffic printer comprising a number of such applicators and a method of cleaning the valves and their openings.

\Norwegian patent No. 311733 (Trysil Maskin) teaches an apparatus intended for suspension to a vehicle for which a pressurized viscous mass container is supplied with viscous mass from a storage container. The mass is discharges thorough a member arranged to be opened and closed by a flapper and having a discharge slot facing the surface below, the axis thereof being perpendicular to the direction of movement. The member arranged to be opened and closed is connected to a secondary valve member which is arranged with an axis parallel to the discharge slot in a cylindrical sleeve shaped element. The secondary valve member is provided with a longitudinally extending groove in the periphery which can connect an inlet slot from the mass container with the discharge slot at the flapper.

This apparatus works satisfactory for traditional application of longitudinal stripes on road surfaces but is not designed for application of patterns and neither for controlled application of marker coatings with improved reflection function for wet marking and for masses which needs heating.

Norwegian patent No. 316 123 (Trysil Maskin) describes an apparatus for suspension to or integration with a vehicle, comprising a pressurized mass container for a liquid, flowable mass from a storage container, said mass being discharged through a valve member having a row of close adjacently arranged flapper elements that can be activated individually. Even tough this design allows application of simple patterns, it does not allow application of more complicated patterns or symbols.

Another disadvantage of the prior art equipment is that the flapper openings tends to get clogged and that no satisfactory measures have been found to remedy that.

From Norwegian patent No. 325 827 is known an apparatus for suspension to or integration with a vehicle for depositing a flowable substance that can form continuous or divided marker coatings on road surfaces, parking areas and the like, comprising a container for the flowable substance, the substance being discharged through a valve member having a number of computer controlled, close adjacently arranged valve elements that can be activated individually by means of a row of activating members having connecting elements to the individual valve elements. This apparatus, however, no more than the other, provides a solution as how to deposit complex patterns, signs or symbols to a surface.

Advanced signs, symbols and writing on road surfaces must still be applied manually by personnel which for that purpose normally must work on a closed part of a partly open road, with the risk for accidents involved in being so close to traffic. It would have been a very significant advantage both in terms of safety and economy if many of the tasks today being made manually by personnel working very close to motorized traffic could be performed more automatically and by personnel mainly working inside a vehicle. There is thus a need for an apparatus which is able to "write" any desired signs and symbols to a surface such as a roadway.

BRIEF DESCRIPTION OF THE DRAWINGS

Below the invention is described in further detail with reference to the accompanying drawings, in which.

DETAILED DESCRIPTION

With reference to the drawings wherein like numerals represent like parts throughout the Figures, an applicator, a traffic printer and a method of cleaning valves thereof are disclosed.

By "viscous mass" as used herein is understood any mass which are flowable at a convenient elevated temperature and which has a viscosity which prevents it from flowing significantly when applied to a surface typically at ambient temperature, such as temperatures in the range from 5° C. to 40° C. Higher or lower temperature may occur exceptionally. Typical masses are resin based but can contain fragments/particles of other materials, e.g. to increase friction or to improve light reflection from a completed, set mass on a surface.

With "surface" as used herein is understood typically a roadway, a parking space, an airport or other areas having paved surface, such as covered by asphalt or concrete, especially surfaces intended for vehicles.

While the complete "traffic printer" according to the present disclosure below is described as a unit assembled from a number of applicators having a common source of the viscous mass, exemplified as comprising five applicators arranged in two rows, more or fewer applicators than those described and illustrated are possible. It is furthermore an option to produce applicators having valves so close to those side walls of the applicators which are parallel to the direction of movement, that the need for applicators in more than one row is eliminated. In the same manner with which a printer for a computer comprises a complete product even though it requires connection to a computer and use of appropriate software (drivers) to function, the present traffic printer according to the present invention is an independent product even though it requires connection to a computer and accompanying software to function in an optimal manner.

Figure 1A:
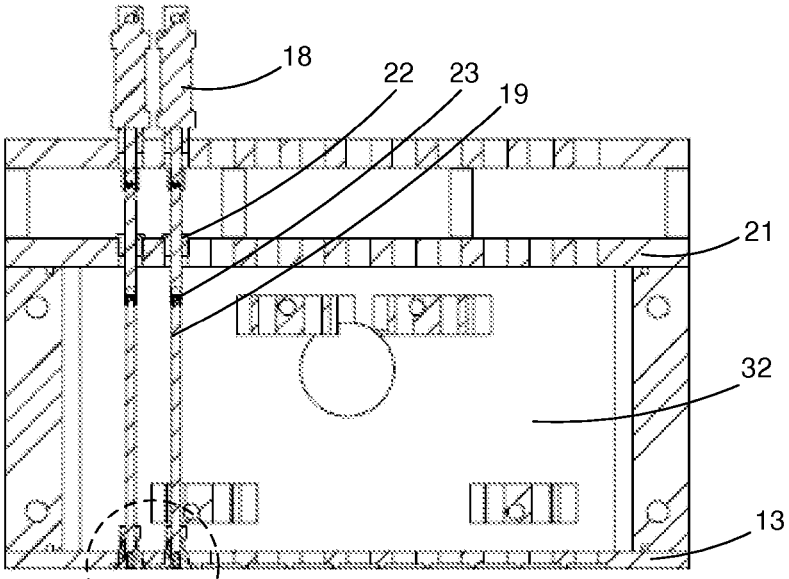
FIG. 1A provides a side sectional view of an embodiment of an applicator according to the present disclosure, FIG. 1B provides a top view of the top cover of the applicator from FIG. 1.
Figure 1B:
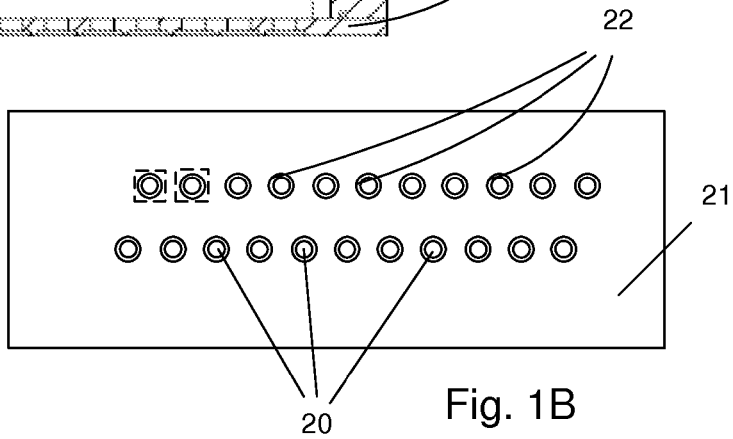
FIG. 1C shows an enlarged section of a detail shown in FIG. 1A.
Figure 1C:
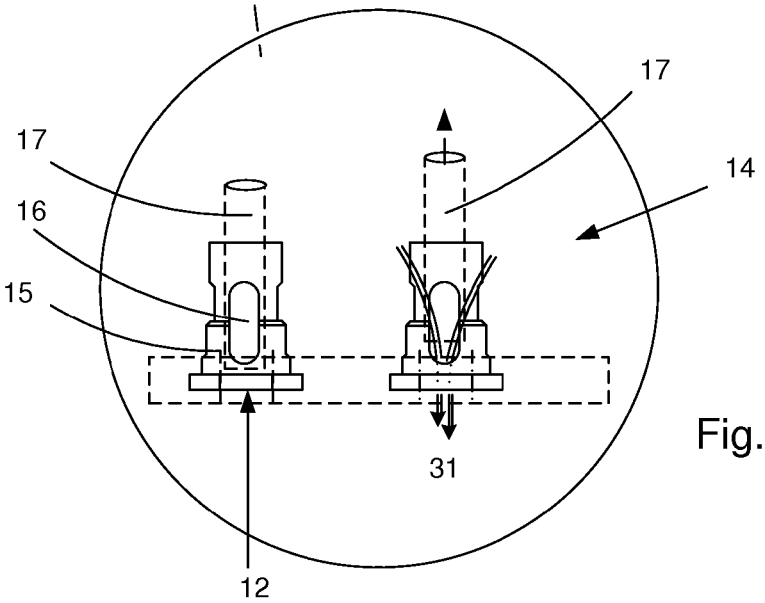

FIGS. 1A-C shows an applicator 11 according to the present disclosure, comprising a number of openings 12 in the bottom wall 13, said openings being arranged to receive and hold tightly, e.g. by a threaded connection in the depicted drawings, valves 14 which can be opened and closed by valve lifters 18 via valve stems 19. The valve stems 19 extend through openings 20 in the applicator top cover 21, and are supported in the openings 20 by packer-free bushings 22 typically made of metal but which may also be made of ceramics or other appropriate durable or wear resistant synthetic materials.

The applicator 11 has in a known manner channels arranged to circulate hot oil to ensure an even and controllable viscosity of the mass to be deposited and to prevent it from setting in the applicator or its openings and valves.

The valve 14 as such comprises an outer valve sleeve 15 which has at least one through opening 16 forming a flow passage from the outside to the inside of the valve sleeve 15. The inner surface of the valve sleeve is smooth and precisely adapted to the outer surface of a valve plug 17 which is slidably arranged in the valve sleeve 15, attached to the valve stem 19 and movable upwards and downwards within limits determined by the valve sleeve, by means of valve plunger 18 attached to the upper end of the valve stem 19 or separably from the latter. The valve sleeve 15 typically has an inner cylinder surface but can also have en inner surface of another shape. In terms of manufacture cylindrical shape is typically the simplest shape and in such a case the valve plug 17 has similar cylindrical piston shape. The valve stem 19 is preferably split in a joint 23 which is adapted to accommodate for tolerance variations with regard to the positioning of the holes 20 in the applicator top cover 21 in relation to the openings 12 in the applicator bottom wall 13. The valve sleeve 15 is adapted to be sealingly and tightly attached in the lower opening 12, preferably by threaded connection.

Each valve stem 19 is attached to a valve lifter 18 which can reciprocate the valve stem 19 up and down respectively by a power impulse which may be hydraulic, pneumatic or in the form of an electromechanically controlled impulse.

According to a preferred embodiment the applicator has two rows of openings 12, provided with valves 14, extending across the width of the applicator. According to a further embodiment the applicator has at least three rows of openings 12 and valves 14 respectively. A person skilled in the art readily understands that the higher the number of rows of valves, the denser the pixels may be arranged so that finer details can be achieved in the printout, provided the valve size is reduced in a manner corresponding to the increase in number.

It is preferred to have at least five openings 12 and valves 14 respectively in each row, more preferred at least eight and most preferred at least ten.

FIG. 1B shows the top cover 21 with openings 20 and bushings 22, the bushings functioning as packer-free sealings around the valve stems 19. Alternatively the valve stems 19 through the openings 20 in the top cover 21 can be provided with glands.

FIG. 1C shows an enlarged section of two valves 14 from FIG. 1A, the left of which being in a closed position while the right of which being in an open position, the valve plug (17) being lifted to an extent an open passage is formed through the opening 16 from the outside of the valve sleeve 15 to its inside. The viscous mass 31 is then allowed to flow through the valve as indicated by arrows on the right drawing indicates.

To ensure flexibility of the system, the power generating unit transmitting power impulses must be arranged to be controlled by a computer processor which can have any outer shape, for instance being a portable PC.

Figure 2:
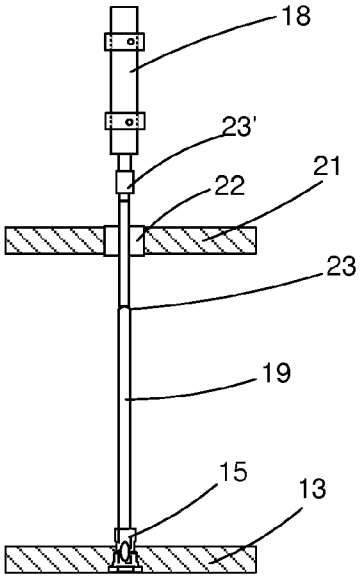
FIG. 2 provides a sectional view of a detail from FIG. 1A.

FIG. 2 shows an enlarged section of a valve 14, valve stem 19 and valve lifter 18 from FIGS. 1A-1C. Joints 23 and 23' are shown also, below and above the applicator top cover 21. The valve stem 19 is not necessarily bendable in said joints, but the joints introduce a certain slack that can compensate for possible tolerance variations in the localization of the holes 12 in the bottom wall 13 compared to the holes 20 in the top cover 21. The joints 23 and 23' may alternatively be real, bendable joints which may be oriented with a mutual angular orientation of 90 degrees to most adequately compensate for variations in an arbitrary direction.

Figure 3:
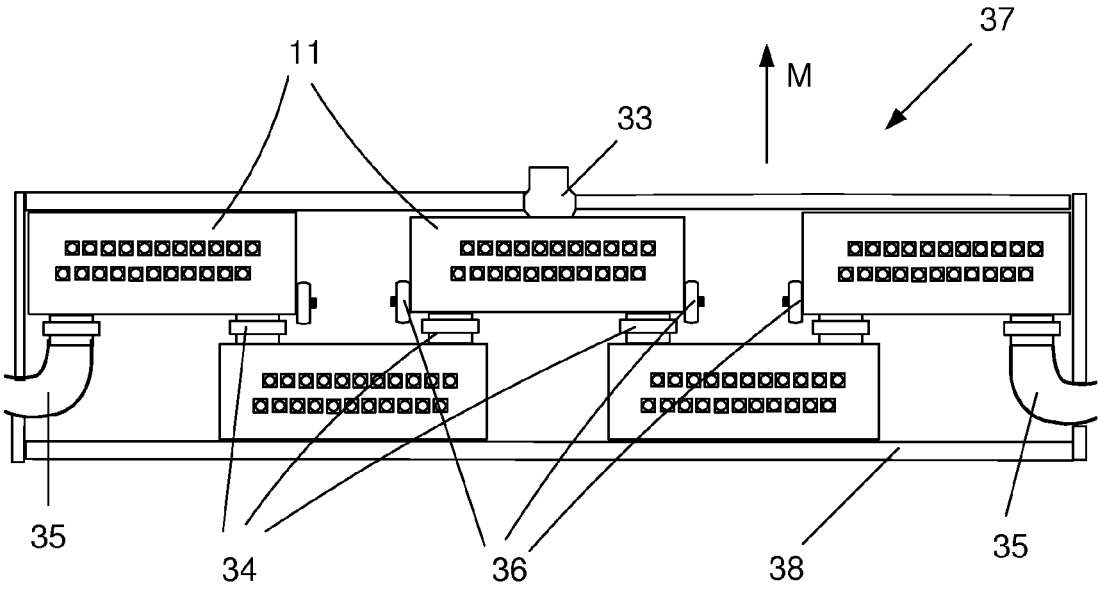
FIG. 3 provides a schematic top view of a number of assembled applicators in an assembly ready for use.

FIG. 3 shows an assembly 37 in the form of a carriage 38 having a width corresponding to the widest area in which printing of letters or other symbols is desired. The depicted assembly 37 (i.e., traffic printer) comprises five applicators 11 arranged in a sideways manner and in order to ensure complete overlap, three are arranged in one row while two are arranged behind those three and laterally biased to cover the lateral interstices between the three applicators in front. In use, the viscous mass is charged to the center applicator 11 through charge chute 33 and is passed on to the other applicators through connecting conduits 34 and recycled to a main container 41 (FIG. 4A) through recycle hoses 35. Each individual applicator 11 of the traffic printer 37 is shown having wheels 36 allowing a vertical position of the individual applicator that is independent of the other ones, determined by the local level of the surface below. This ensures that each applicator can be positioned near the surface even when there are local level variations in the direction perpendicular to the direction of movement for the traffic printer.

Figure 4A:
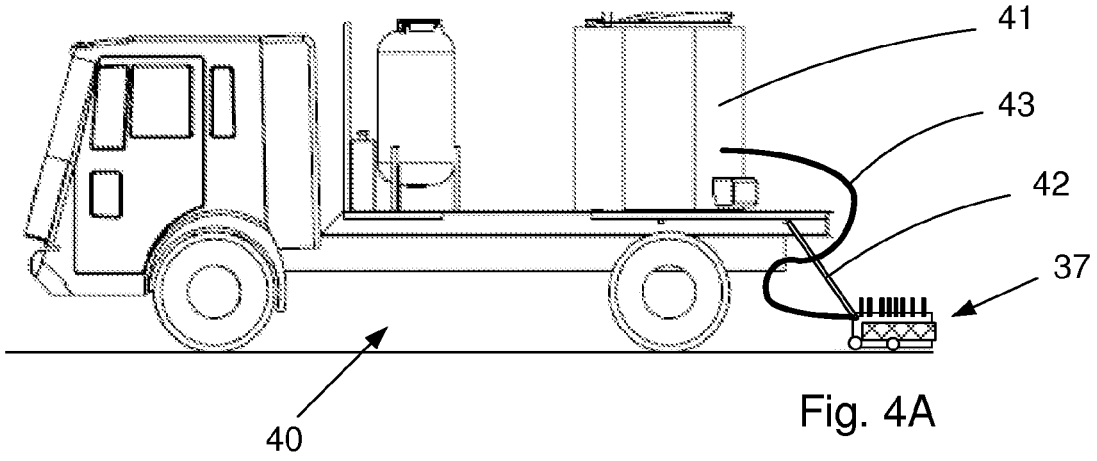
FIG. 4A shows schematically the assembly from FIG. 3 in use.

FIG. 4A shows schematically a traffic printer 37 in use, suspended behind a vehicle 40 which comprises a main container 41 for the viscous mass. The carriage 38 of the traffic printer 37 is held by arms 42 that can be controlled e.g. hydraulically. Supplying and recycling of viscous mass is made through flexible hoses 43.

In the practice use of traffic printer 37, the controlling of the opening and closing of valves of each applicator is performed a computer program to which the user inputs information of the signs or symbols to be printed. "Printing" on a road or like surface by the traffic printer via moving vehicle is mimicked on a smaller scale by printing on a piece of paper moving past a printer head. In the same manner that the printing software controls flow of ink to printer nozzles over the paper, with dependence on the speed with which the paper moves past the printer head the speed at which the valves are opened and closed must be controlled in dependence on the velocity with which the vehicle with the traffic printer according to the present invention moves. It is not certain that the velocity will be constant in the "printout period" and the computer system therefore uses real time information of the actual speed or other movement or positioning. The mechanism for systems for controlling speed, movement and positioning is not described in further detail.

A particular feature that the controlling software must account for, in a case as shown in FIG. 3, is the fact that the applicators are typically arranged in two rows and that "printout" from the applicators in the back row must be delayed in dependence of speed to be correctly deposited in relation to "pixels" deposited from the applicators in the front row. In practice the controlling software can operate with exact positioning at any given time rather than corresponding time and speed.

Correspondingly the software can account for mutual delay between valves arranged in different rows across the direction of movement between valves in different rows within one and the same applicator, when the applicators 11 have two (as shown) or more rows of valves 14.

It should be emphasized that the controlling of the applicator valves can be obtained in many different ways and is as such not limiting. The controlling software can be implemented in many different ways. A preferred variant involves use of bitmap files in which the desired signs, symbols and patterns are coded in, divided in pixels. In addition a printer driver translating such bitmap files to instructions that can be interpreted by the traffic printer is needed, hereunder included the particular delays related to different positions in the direction of movement. The encoding of the software is not described in detail.

As shown and described, the valves for opening and closing is packer-free and thereby have a more consistent behavior than prior art valves while exhibiting lower friction, thereby allowing rapid opening and closing without use of conventional hydraulic equipment for controlling and closing. Use of valves being equipped with packers would imply larger degree of friction variation from valve to valve and over time, so that the different valves would show a different response on a controlling signal. This would lead to a less even result with respect to mass applied. Valves having a low friction during opening and closing also can be controlled with less force, such as e.g. use of rapid air cylinders or small electric actuators rather than slower, but stronger, oil based hydraulic cylinders.

Good results over a long period of time often depend upon maintaining clean equipment, especially ensuring that the area around the valve openings 12 does not become clogged by more or less set mass remaining from earlier applications. It is thus important to have reliable procedures for cleaning the valves. For existing, simpler applicators the cleaning has been done manually or immediately before use discharging fresh, hot mass that dissolves and tear away any set mass from earlier applications. The drawback is that these procedures contaminate the equipment and require loss of mass.

Figure 4B:
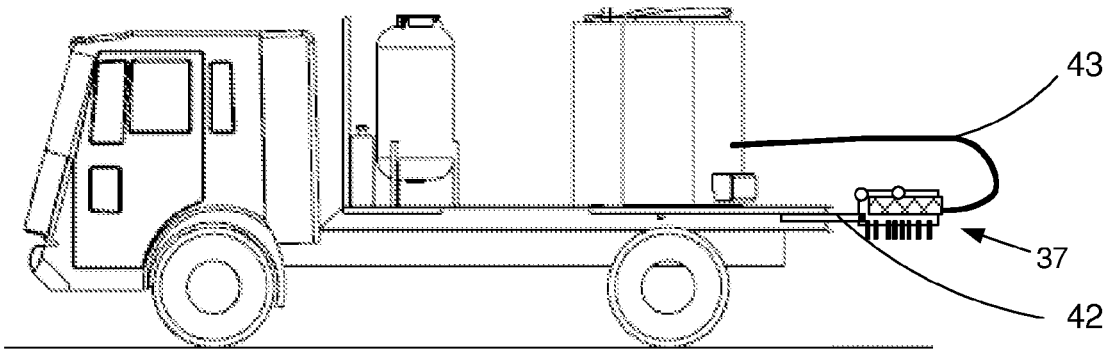
FIG. 4B shows schematically the assembly from FIG. 3 when being cleaned according to the disclosed method.

With reference to FIG. 4B, an inventive method of cleaning is disclosed. As shown, the carriage 38 of the traffic printer 37 is hinged so that it can be pivoted about a horizontal axis to an inverted position. Keeping the applicator in the depicted inverted position and having pumped (completely or partly) the viscous mass back to the main container 41 for such mass on the vehicle 40, a sub-pressure can be set up in the applicators by means of a pump (not shown), and while such sub-pressure connected, the valves of each applicator may be opened and closed quickly, preferably in sequence, so that only one or a few is open at a time. Any partly set mass at the valve orifice then will be sucked into the applicator and mixed with hot, fresh mass making the partly set mass to again become flowable. When the applicators are inverted as depicted, it is also advantageous to perform a visual inspection of the valve orifices and if required manually remove any remains left behind.

The invention claimed is:

1. An applicator (11) for application of a viscous mass (31) to a surface (33) comprising a bottom wall (13) and a heated chamber (32) in communication with bottom wall openings (12) controlled by valves (14) allowing dropwise discharge of the viscous mass to the surface, characterized in that each of the valves (14) are non-packed and comprise an outer sleeve (15) having a smooth internal surface and at least one through opening (16) in a wall of the outer sleeve (15), and a valve plug (17) with a smooth outer surface configured to substantially conform to the internal surface of the outer sleeve (15), the valve plug (17) being arranged to be reciprocated from a closed position completely sealing the at least one through opening (16) in the wall of the outer sleeve (15), to an elevated open position in which at least the lowermost part of the at least one through opening (16) is uncovered, thereby allowing viscous mass (31) to pass therethrough from the outside of the outer sleeve (15) towards one of the bottom wall openings (12).

2. The applicator (11) of claim 1, wherein the valve plug (17) is reciprocated by a valve lifter (18).

3. The applicator of claim 2, further comprising a top cover (21) offset from the bottom wall (13), wherein the valve lifter (18) is arranged on top of the applicator (11) via a valve stem (19) which penetrates the applicator, the valve stem (19) being non-packed and sealed by a bushing (22) in top cover openings (20) in the applicator (11).

4. The applicator of claim 3, wherein the valve stem (19) is provided with a joint (23) within the applicator (11) to compensate for minimal tolerance variations of the positioning of the top cover openings (20) provided with bushings (22) in the top cover relative to the positioning of the bottom wall openings (12) provided with valves (14) in the bottom wall (13) of the applicator.

5. The applicator of claim 2, wherein the valve lifter (18) is controlled hydraulically.

6. The applicator of claim 2, wherein the valve lifter (18) is controlled pneumatically.

7. The applicator of claim 2, wherein the valve lifter (18) is controlled electromechanically.

8. The applicator of claim 1, comprising at least two rows of bottom wall openings (12) provided with valves (14), said rows extending transversely in relation to the direction (M) of movement for the applicator (11).

9. The applicator of claim 8, comprising at least 5 bottom wall openings (12) and valves (14) in each row.

10. The applicator of claim 8, comprising at least 8 bottom wall openings (12) and valves (14) in each row.

11. The applicator of claim 8, comprising at least 10 bottom wall openings (12) and valves (14) in each row.

12. The applicator of claim 8, comprising at least three rows of bottom wall openings (12) and valves (14).

13. A traffic printer for application of a viscous mass (31) to a surface, comprising a plurality of the applicators (11) of claim 1 arranged in an assembly (37), said applicators being provided with wheels (36) arranged to rest against the surface (33), thereby accommodating lateral height variations of the surface.

14. The traffic printer of claim 13, configured for suspension from a vehicle (40).

15. The traffic printer of claim 13, comprising applicators (11) arranged in two rows with at least one valve for each lateral point across the width of the traffic applicator assembly.

* * * * *